United States Patent [19]

Fischer et al.

[11] 3,946,750

[45] Mar. 30, 1976

[54] LABEL REMOVER FOR BOTTLE WASHING MACHINE

[75] Inventors: Otto H. Fischer, Milwaukee; Donald F. Schoenke, Menomonee Falls, both of Wis.

[73] Assignee: Stowell Industries, Inc., Milwaukee, Wis.

[22] Filed: Mar. 5, 1975

[21] Appl. No.: 555,415

[52] U.S. Cl. ..... 134/104; 134/125; 134/152; 134/169 R

[51] Int. Cl.[2] ..... B08B 3/02; B08B 9/08

[58] Field of Search ..... 134/72, 83, 104, 109, 111, 134/125, 131, 152, 165, 169 R, 171

[56] References Cited

UNITED STATES PATENTS

| | | | |
|---|---|---|---|
| 2,050,634 | 8/1936 | Stegemann | 134/104 UX |
| 2,573,169 | 10/1951 | Gerlach et al. | 134/104 |
| 2,617,435 | 11/1952 | Kessler | 134/125 X |
| 2,655,928 | 10/1953 | Herold | 134/125 X |
| 3,104,670 | 9/1963 | Girton | 134/83 X |

FOREIGN PATENTS OR APPLICATIONS

| | | | |
|---|---|---|---|
| 1,146,280 | 5/1957 | France | 134/104 |

*Primary Examiner*—Robert L. Bleutge
*Attorney, Agent, or Firm*—Michael, Best & Friedrich

[57] ABSTRACT

Labels are removed from the bottles as they stand generally upright in the conveyor pockets at the bottom of the curved guide where they pass under the high volume nozzles fed by a supply manifold approximately at the center of the curvature of the solid guides. At the time of label removal the bottles are under the liquid level of the caustic bath in the bottle washing machine. The open slot on the bottom of the solid curved guide leads to a suction channel which pulls the labels from the caustic solution as fast as they are flushed off the bottles. The suction channel is tapered to obtain substantially equal suction across the slot. Since the bottles are moving on a curved path as they pass under the jet, there is an effective dwell during the flushing and a single nozzle can accomplish more flushing action than in prior designs.

8 Claims, 2 Drawing Figures

44
48
46
42
36
38
40
52
12
11
10
26
36
30
28
24
14
14
12

LABEL REMOVER FOR BOTTLE WASHING MACHINE

BACKGROUND OF THE INVENTION

In the usual bottle washing machine the bottles are conveyed through the machine in pockets which are shaped to permit liquid to be forced through the pocket from either the top or the bottom. The pockets are designed to retain the bottles when they are carried upside down or upright in conjunction with a guide. As the bottles travel through the machine they are first subjected to a caustic soak in a solution approximately 71°C. The caustic has a germicidal effect as well as loosening deposits present on or in the bottles and softening glue so that the old labels can be removed. After about four minutes soak time the labels are ready for removal. In the prior designs this has been accomplished by passing the bottles under a series of jets which function to flush the label from the bottle.

In order to increase production of bottle washing machines it is desirable to increase the conveyor speed and the prior type of label removal by passing the bottle under plural jets becomes less and less satisfactory since not enough time is spent under the jets to get a good flushing action. It becomes more and more difficult to remove labels as the speed increases. To mount the jets on a reciprocating cross head does not represent a viable answer since the reciprocating action must be fast and the forces and wear greatly increase.

SUMMARY OF THE INVENTION

The object of this invention is to provide a label remover which can operate in conjunction with high conveyor speeds and provides adequate time in the flushing station to remove the labels. This present arrangement does not involve any moving parts other than the conveyor transporting the bottles through the bottle washing machine. All the flushing nozzles are fixed.

DESCRIPTION OF THE PREFERRED EMBODIMENT

Figure 1:
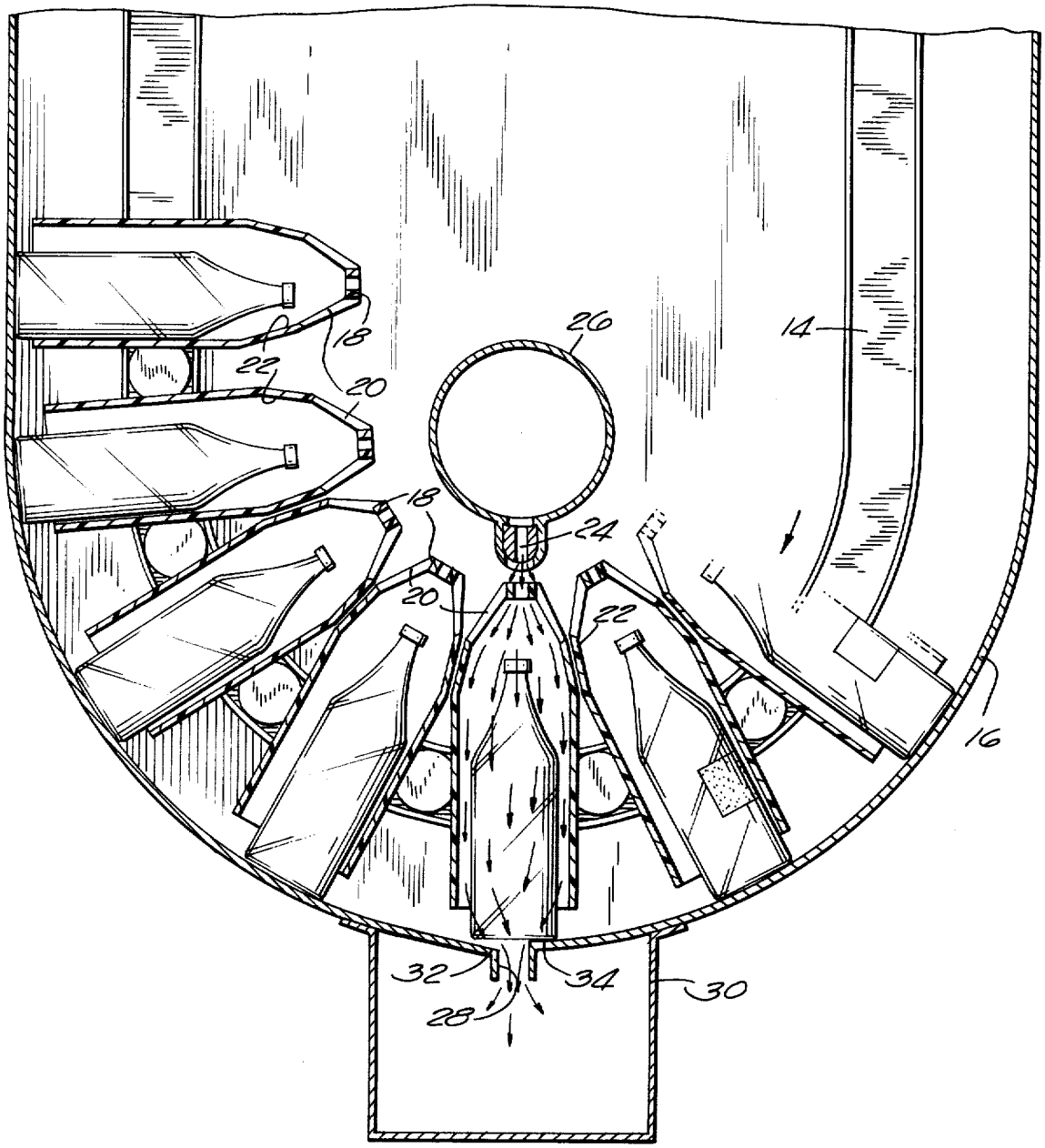
FIG. 1 is a vertical section through the label removing station in a bottle washing machine.

As is customary in bottle washing machines, the present arrangement conveys bottles through the bottle washing machine in individual pockets 10. In the machine shown here there are four pockets in each flight. The four pockets in each flight are connected together by members 11 across the machine. At each end of each flight a pair of spaced rollers 12 are mounted to run inside the cam tracks 14. Thus each flight of bottles is always kept normal or perpendicular to the immediately adjacent cam track 14. The pockets 10 are generally plastic and have an annulus 18 supported by webs 20 from the main body 22 of the pocket. The open webbing permits water to be passed into or drained from the pocket over substantially the entire diameter of the bottle and the annulus 18 permits water to be directed into the interior of the bottle as required at some of the operating stations. The bottle is centered in the pocket when the pocket is inverted. In FIG. 1 the pockets move down from a horizontal position into the curved guide. The bottles then rest on and are supported by the guide. The guide 16 is solid . . . imperforate. The label removal station is located below the level of the caustic solution so that the bottles and labels are wet when they arrive at the flushing station. When the bottle reaches the bottom of the curve as shown in FIG. 1, it is centered directly under the high volume nozzle 24 fed by supply manifold 26. These nozzles are designed to spray liquid (if spray can be used in the context of an underwater flow) down through the pocket. Since the bottle is following a curved path with the center of curvature being the center of the supply manifold, the bottle, in effect, is made to dwell under the nozzle and it has a longer period of time to enter and leave the spray pattern.

The solid guide 16 is provided with a slot 28 across the bottom of the guide. The slot or opening leads to the suction channel 30 and a substantial suction or reduced pressure is set up in the channel. Therefore, the liquids coming from the bottom of the pocket at the flushing station and all the entrained labels or parts of labels will be withdrawn immediately through the slot into the suction channel. It will be noted that the trailing side 32 of the slot is lower than the leading side 34. This, then, provides an opening under the bottle as shown through which labels can be drawn. As the bottle leaves the removal station the trailing part of the bottle passes over the slot and any label hung up on that side of the bottle can be flushed into the slot.

With the high pressure water jet hitting the bottle from above and substantial suction applied below the pocket, a high velocity flow is set up across the bottle in the flushing station. This is very effective in removing the label and immediately flushing it into the suction channel 30.

Figure 2:
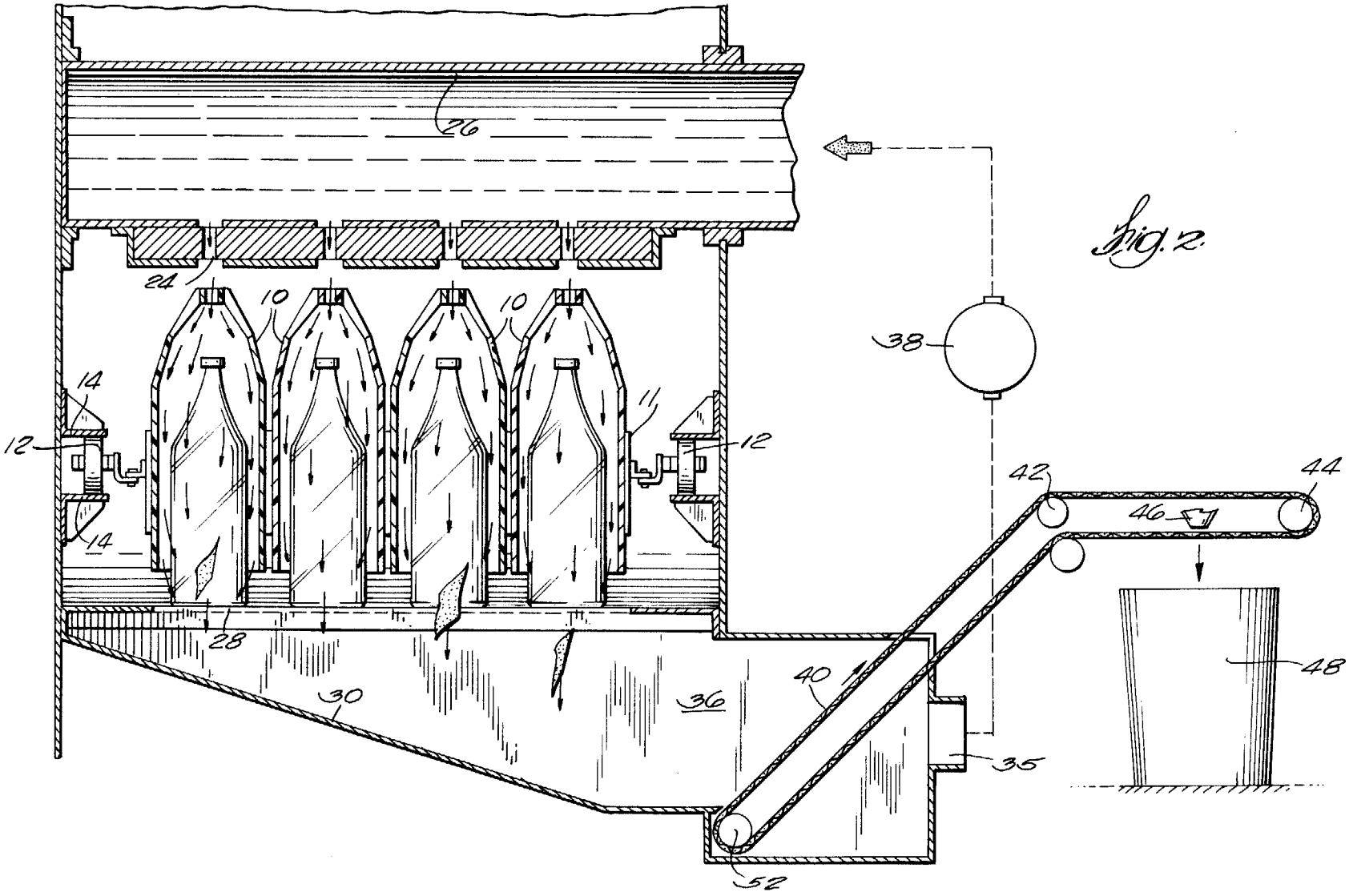
FIG. 2 is a vertical section taken at 90° to FIG. 1.

The suction channel increases in cross sectional area from left to right in FIG. 2 as it approaches the conduit 35 leading to pump 38 which recirculates the liquid back to the supply conduit or manifold 26. Thus the area of the suction channel increases as it approaches the exit area 36. At this point the liquid with the entrained labels must pass through the traveling screen 40. The surface of the traveling screen which picks up the labels is traveling upwardly in FIG. 2 and passes over rollers 42 and 44 and on the return portion passes under the flushing nozzles 46 which rinse the labels from the screen into the waste container 48. The screen then travels over roller 50 back to the bottom roller 52.

With the effective dwell achieved by passing the bottles on a curved path under the flushing nozzles, the conveyor can be operated at high speed while obtaining adequate time under the high volume, high velocity stream established by the high pressure, high volume nozzles in combination with the suction applied immediately below the bottle. This arrangement removes labels in less time than prior arrangements and makes increased conveyor speeds practical. The pockets confine the large volume of water and the water must pass through the space between the solid wall of the pocket and the bottle and this enhances the flushing action.

We claim:

1. In a bottle washing machine of the type which conveys bottles through the machine in individual pockets which allow flow of liquid through the pocket, an improved label removal structure, comprising, a liquid supply manifold provided with a high volume downwardly directed nozzle, an imperforate guide, means conveying the pockets over a path in which the bottles in the pockets pass under the nozzle in an upright position, an opening in the guide below the nozzle for withdrawal of liquid, and a pump for pumping liquid through the opening and returning it to the supply manifold.

2. Apparatus according to claim 1 in which the guide is curved about a center generally in the proximity of the nozzle whereby the bottle effectively remains in the nozzle flow pattern a longer period of time.

3. Apparatus according to claim 2 in which the label removal structure is located below the level of liquid maintained in the washing machine at that location.

4. Apparatus according to claim 3 in which the edge of the opening first encountered by the bottle is slightly closer to the center of curvature of the guide than is the edge last to be encountered.

5. Apparatus according to claim 4 including means located between said opening and said pump for removing entrained labels from the liquid.

6. Apparatus according to claim 3 in which the conveyor transports a plurality of bottles side-by-side on each conveyor flight and there is a separate nozzle positioned over each bottle path, said opening being in the form of a slot across all the paths of bottle travel, a channel located below the slot and leading to the pump, said channel being shaped to generally equalize the suction applied across the length of the slot by the pump.

7. Apparatus according to claim 6 in which the channel is shaped to increase the cross sectionsl area of the channel in the direction approaching the inlet of the pump.

8. Apparatus according to claim 7 in which the body of each pocket is imperforate and confines the flow.

* * * * *